US011136983B2

(12) United States Patent
Mayleben et al.

(10) Patent No.: US 11,136,983 B2
(45) Date of Patent: Oct. 5, 2021

(54) DUAL INLET VOLUTE, IMPELLER AND PUMP HOUSING FOR SAME, AND RELATED METHODS

(71) Applicant: Wayne/Scott Fetzer Company, Westlake, OH (US)

(72) Inventors: Philip Anthony Mayleben, Brookville, IN (US); Buford Alan Cooper, Sunman, IN (US)

(73) Assignee: Wayne/Scott Fetzer Company, Westlake, OH (US)

( * ) Notice: Subject to any disclaimer, the term of this patent is extended or adjusted under 35 U.S.C. 154(b) by 329 days.

(21) Appl. No.: 15/809,778

(22) Filed: Nov. 10, 2017

(65) Prior Publication Data

US 2018/0128272 A1 May 10, 2018

Related U.S. Application Data

(60) Provisional application No. 62/420,133, filed on Nov. 10, 2016.

(51) Int. Cl.

| | |
|---|---|
| ***F04D 1/00*** | (2006.01) |
| ***F04D 29/18*** | (2006.01) |
| ***F04D 29/22*** | (2006.01) |
| ***F04D 29/62*** | (2006.01) |
| ***F04D 29/44*** | (2006.01) |
| ***F04D 29/24*** | (2006.01) |
| ***F04D 13/08*** | (2006.01) |

(52) U.S. Cl.

CPC ..... *F04D 1/006* (2013.01); *F04D 13/086* (2013.01); *F04D 29/185* (2013.01); *F04D 29/2205* (2013.01); *F04D 29/2244* (2013.01); *F04D 29/242* (2013.01); *F04D 29/445* (2013.01); *F04D 29/624* (2013.01)

(58) Field of Classification Search

CPC .... F04D 1/006; F04D 29/185; F04D 29/2244; F04D 29/624; F04D 29/445; F04D 29/242; F04D 29/2205; F04D 13/086; F04D 15/0218; F04D 13/08; F04D 13/12

See application file for complete search history.

(56) References Cited

U.S. PATENT DOCUMENTS

| | | | | |
|---|---|---|---|---|
| 2,143,032 A | | 1/1939 | Ruthman | |
| 2,207,183 A | | 7/1940 | Thrush | |
| 2,553,066 A | * | 5/1951 | Southern | F04D 9/02 415/146 |
| 2,736,266 A | | 2/1956 | Eisele | |
| 2,766,697 A | | 10/1956 | Judd | |
| 2,787,960 A | | 4/1957 | Wightman | |

(Continued)

OTHER PUBLICATIONS

Blue Angel Pump Company, Blue Angel Catalog, 2018, 34 pp.
Blue Angel Pump Company, Blue Angel Catalog, Oct. 2015, 39 pp.
Wayne Water Systems, Wayne Catalog, Oct. 2014, 52 pp.

*Primary Examiner* — Eldon T Brockman
(74) *Attorney, Agent, or Firm* — Fitch, Even, Tabin & Flannery, LLP

(57) ABSTRACT

Disclosed herein are a dual inlet volute with an impeller and pump for same, and related methods. In one form a pump is provided comprising a motor configured to rotate a shaft, an impeller operatively coupled to the shaft, and a volute housing the impeller, the volute having a first inlet, a second inlet, and a discharge in fluid communication with the first and second inlets.

26 Claims, 7 Drawing Sheets

(56) References Cited

U.S. PATENT DOCUMENTS

| | | | | | |
|---|---|---|---|---|---|
| 2,808,782 | A | | 10/1957 | Thompson | |
| 3,260,214 | A | | 7/1966 | Goettl | |
| 3,936,240 | A | * | 2/1976 | Dochterman | F04D 17/12 417/368 |
| 4,563,123 | A | | 1/1986 | Beck | |
| 4,728,256 | A | | 3/1988 | Araoka | |
| 4,820,131 | A | | 4/1989 | Johnson | |
| 4,961,018 | A | | 10/1990 | Akhter | |
| 5,055,000 | A | | 10/1991 | Akhter | |
| 5,145,337 | A | | 9/1992 | Kirkland | |
| 5,181,841 | A | | 1/1993 | Kirkland | |
| 5,205,725 | A | | 4/1993 | Pattison | |
| 5,246,336 | A | | 9/1993 | Furukawa | |
| 5,599,164 | A | * | 2/1997 | Murray | F04D 13/14 415/144 |
| 6,375,430 | B1 | | 4/2002 | Eckert | |
| 6,443,715 | B1 | | 9/2002 | Mayleben | |
| 6,464,531 | B2 | | 10/2002 | Eckert | |
| 6,514,053 | B2 | | 2/2003 | Takura | |
| 6,619,910 | B1 | | 9/2003 | Burgess | |
| 6,676,382 | B2 | | 1/2004 | Leighton | |
| 6,824,350 | B2 | | 11/2004 | Pares Criville | |
| 7,153,418 | B2 | | 12/2006 | Mauro, Sr. | |
| 7,329,085 | B2 | | 2/2008 | Walker | |
| 7,357,341 | B2 | | 4/2008 | Gutwein | |
| 7,544,041 | B2 | | 6/2009 | Mayleben | |
| 7,597,732 | B2 | * | 10/2009 | Yokota | B01D 19/0052 55/406 |
| 7,810,362 | B2 | | 10/2010 | Harwood | |
| 8,380,355 | B2 | | 2/2013 | Mayleben | |
| 8,439,642 | B2 | | 5/2013 | Scott | |
| 8,511,998 | B2 | | 8/2013 | Burgess | |
| 8,622,706 | B2 | | 1/2014 | Burgess | |
| 9,212,443 | B2 | | 12/2015 | Harwood | |
| D868,117 | S | | 11/2019 | Mayleben et al. | |
| 2006/0064954 | A1 | * | 3/2006 | Yokota | B01D 19/0052 55/406 |
| 2014/0044545 | A1 | | 2/2014 | Burgess | |

* cited by examiner

DUAL INLET VOLUTE, IMPELLER AND PUMP HOUSING FOR SAME, AND RELATED METHODS

CROSS-REFERENCE TO RELATED APPLICATION

This application claims priority to U.S. Application No. 62/420,133, filed on Nov. 10, 2016, which is incorporated herein by reference in its entirety.

FIELD

This invention relates generally to pumps and, more particularly, to pumps with a double suction impeller, and methods related to same.

BACKGROUND

Pumps with double suction impellers are currently used to increase suction performance and to reduce axial thrust. These pumps are made with the two sides of the impeller being nearly identical to each other.

Two common types of impellers are centrifugal and vortex. Centrifugal impellers require fluid to pass through the vanes and are highly efficient. However, many designs are easily clogged by debris. Vortex pumps are less efficient and do not require fluid to pass through vanes and are therefore more tolerant of debris.

Additionally, bottom suction pumps can experience air lock if not properly vented. Whereas top suction pumps are ineffective at completely emptying areas of liquid.

Accordingly, it has been determined that a need exists for a dual inlet volute with a double impeller for creating flow through each inlet.

BRIEF DESCRIPTION OF THE FIGURES

Embodiments of the invention are illustrated in the figures of the accompanying drawings in which.

Figure 1A:
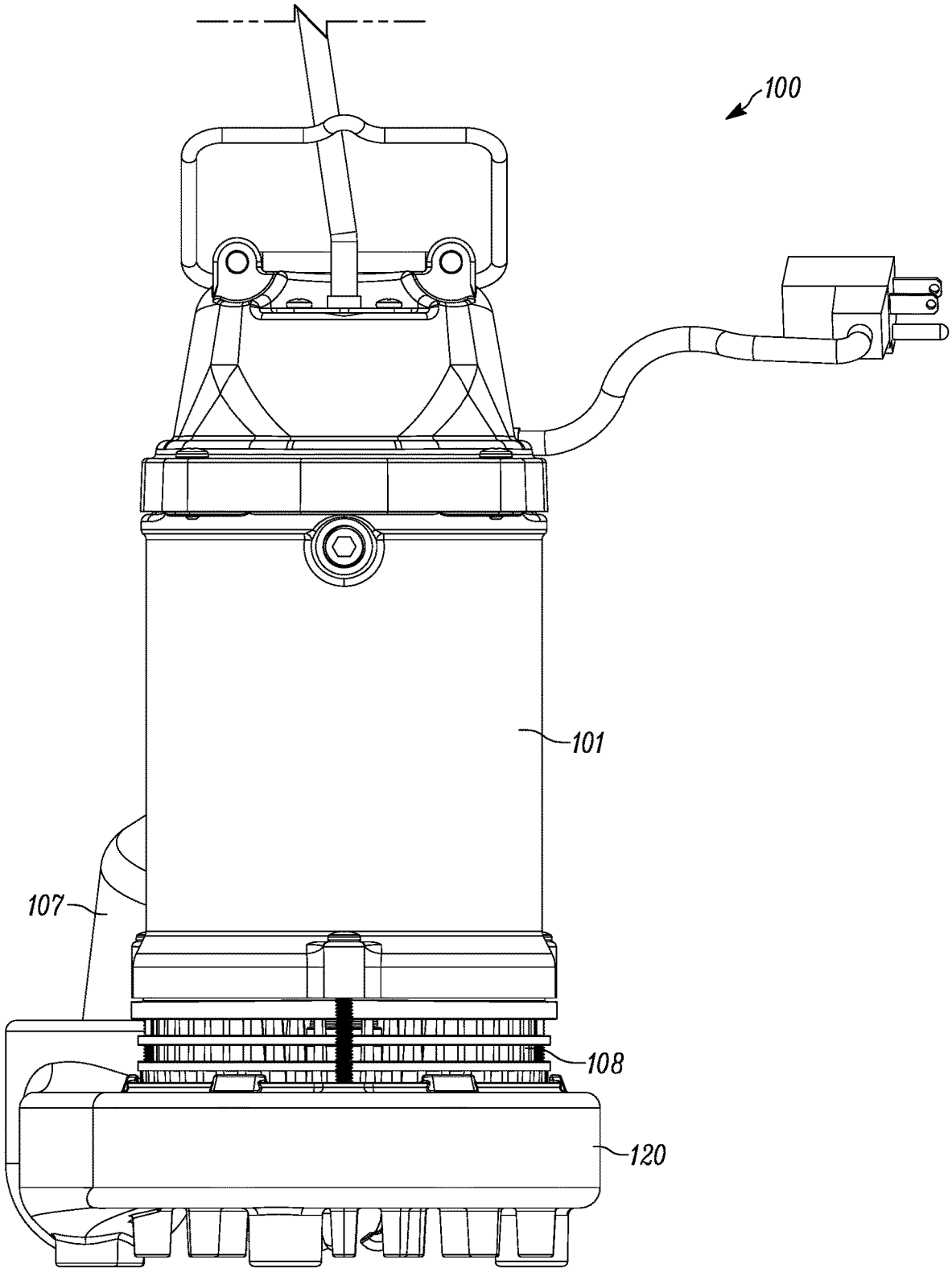
FIG. 1A is a front elevated view of a pump with a dual inlet volute.
Figure 1B:
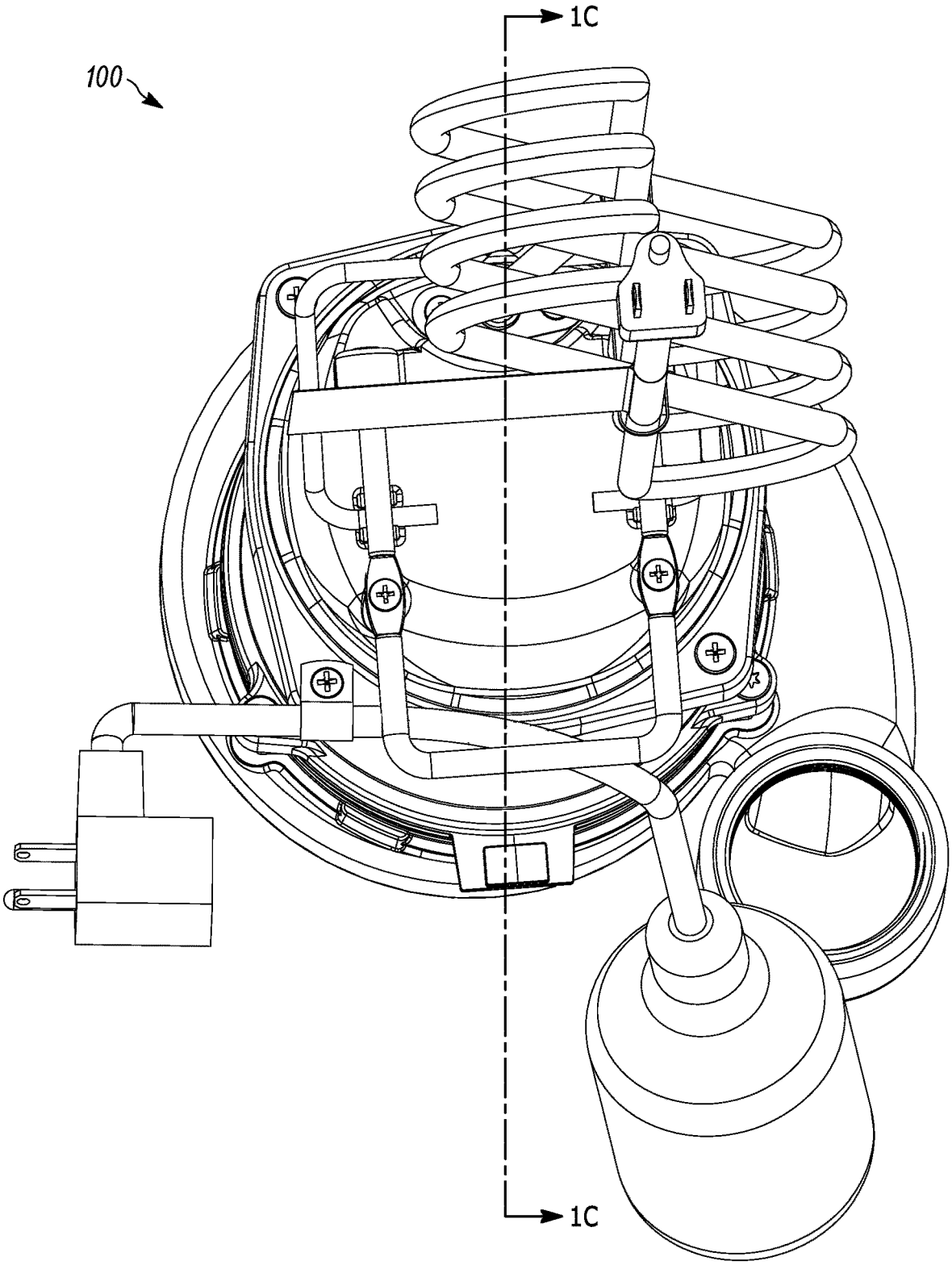
FIG. 1B is a top view of the pump of FIG. 1A.
Figure 1C:
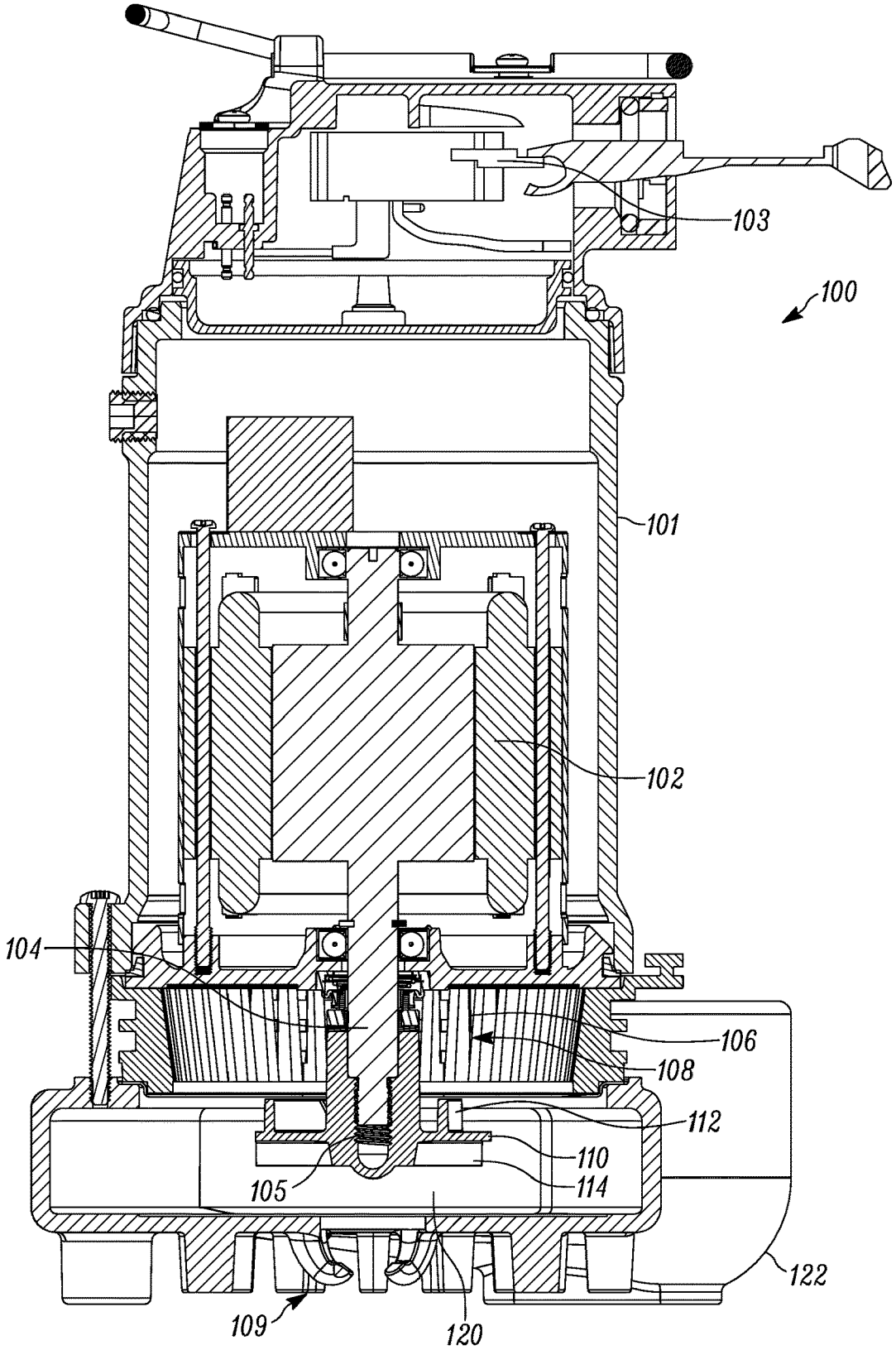
FIG. 1C is a cross-section view of the pump of FIGS. 1A-1B taken along the line 1C in FIG. 1B.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE PREFERRED EMBODIMENTS

Many variations of pumps are discussed herein and even further are contemplated in view of this disclosure. The pumps discussed herein are configured, and designed, to be submerged in a liquid to pump the liquid in which it is submerged through an attached discharge hose or discharge pipe. The pumps herein can be utility pumps, sump pumps, well pumps, sewage/effluent pumps, aquarium pumps, pool pumps, lawn pumps, or any other type of pump. The pumps herein can be vertically configured pumps or horizontally configured pumps. In some embodiments and some applications, despite being called a double suction impeller, one of the two impeller halves will be used solely for venting, and thus only one of the impeller halves provides suction.

FIGS. 1A-3B illustrate a pump assembly having a duel inlet volute 120 and double suction impeller 110. FIG. 1C shows a cross sectional view of a pump 100 with a double suction impeller 110 along the line 1C of FIG. 1B. The pump 100 includes a motor 102 contained within a motor housing 101. The motor 102 is controlled by the electrical components 103. The pump 100 has a float switch 107 (see FIG. 1A) to control operation of the motor 102 by detecting the presence of fluid, such as water. The motor 102 turns the shaft 104. The double impeller 110 has a hub 105 that connects to the shaft 104 such that the motor 102 rotates the double impeller 110. As mentioned above, this double suction impeller concept can be utilized with any type of pump (e.g., utility, sump, effluent, aquarium, etc.) and with any type of pump configuration (e.g., vertically configured pumps (as shown), horizontally configured pumps, etc.). Examples of vertically configured pumps are shown in U.S. Pat. No. 2,701,529, to H. Finzel; U.S. Pat. No. Re. 24,909, to R. W. Dochterman; U.S. Pat. No. 4,345,879, to C. W. Steiner; U.S. Pat. No. 3,234,881, to W. J. Ekey; and U.S. Pat. No. 4,396,353, to R. D. MacDonald. Examples of a horizontally configured pumps are shown in U.S. Pat. No. 2,608,157, to W. J. Conery.

The electrical components 103 can includes control circuitry. The control circuitry controls the power supply to selectively provide power to the motor 102. The control circuitry generally includes some method of detecting liquid, such as a float switch or a capacitive water sensor. Alternatively, the control circuitry could be a switch operable by a user.

The double suction impeller 110 has a top impeller portion or top impeller 112, which provides a first style of pumping, and a bottom impeller portion or bottom impeller 114, which provides a second style of pumping. In the example shown, the top impeller 112 is a centrifugal impeller which produces centrifugal style flow and the bottom impeller 114 is a vortex impeller which produces vortex style flow.

The double impeller 110 is positioned in a dual inlet volute 120 which includes a top inlet 108, a bottom inlet 109, and a discharge 122 not shown on FIG. 1. The top inlet 108 is surrounded by a screen 106 which blocks large debris from entering the volute 120 and the top impeller 112. The bottom inlet 109 can be either unscreened, or can have a larger screen than the top inlet 108 as vortex impellers are less affected by debris. The top inlet 108 is in fluid communication with the top impeller 112, meaning fluid is drawn through the top inlet 108 by the top impeller 112. The bottom inlet 109 is in fluid communication with the bottom impeller 114, meaning fluid is drawn through the bottom inlet 109 by the bottom impeller 114. The top inlet 108 aids in venting the volute 120 to reduce the likelihood of the bottom impeller 114 failing due to an air lock.

Figure 3A:
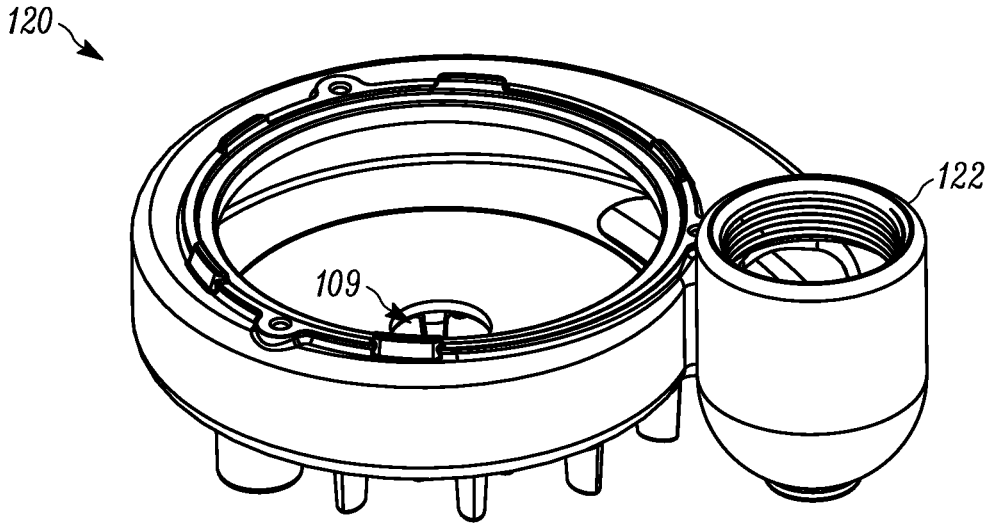
FIG. 3A is a perspective view of the dual inlet volute of the pump of FIGS. 1A-1C.
Figure 3B:
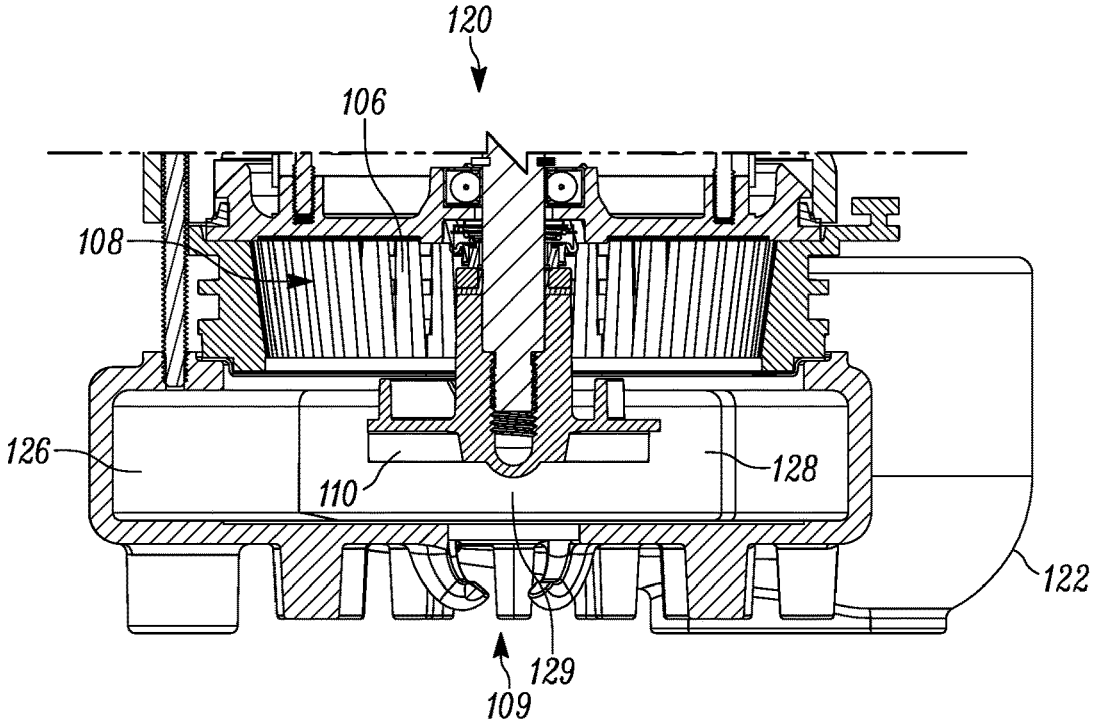
FIG. 3B is an expanded cross-sectional view of the pump of FIGS. 1A-1C showing the volute of FIG. 3A.

Referring to FIGS. 3A-3B, the volute 120 has an open top which forms a top inlet 108 and a center aperture in the bottom to form bottom inlet 109. The volute 120 defines an open cavity between the two inlets 108, 109 in which the impeller 110 is positioned. The impeller draws fluid through one or both inlets 108, 109 and forces the liquid out through the discharge 122.

Figure 2:
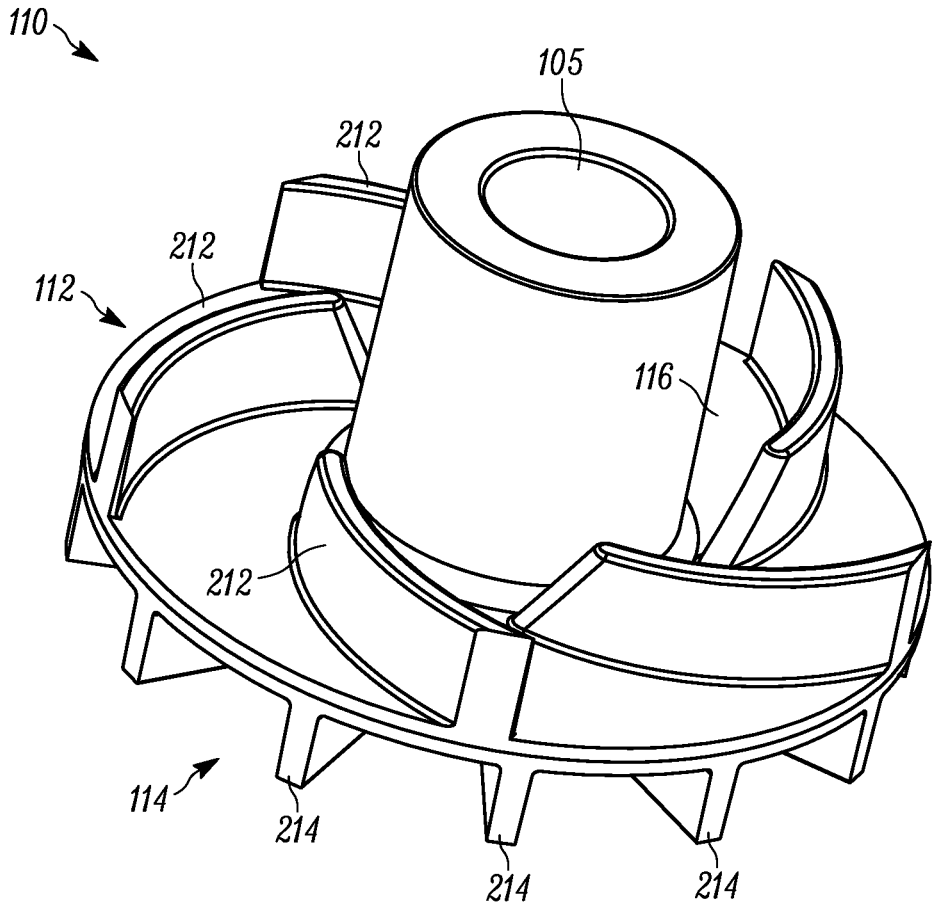
FIG. 2 is a perspective view of the double suction impeller of the pump of FIGS. 1A-1C.

Referring to FIG. 2, the top impeller 112 of the double impeller 110 has a plurality of vanes 212. Rotation of the double impeller 110 causes fluid to be drawn through the centrifugal vanes 212, and then the centrifugal vanes 212 transport the fluid out to the impeller outer diameter. The bottom impeller 114 of the double impeller 110 has a plurality of vortex vanes 214 that are of a different shape and configuration from the centrifugal vanes 212. In one embodiment the centrifugal vanes 212 curve as they extend outward from the center of the double impeller 110 as shown. The vortex vanes 214 extend radially from the center of the double impeller 110. In alternative embodiments, different shapes and configurations of vanes can be used to achieve a similar effect. When the double impeller 110 is rotated, the vortex vanes 214 induce a whirlpool or vortex below the double impeller 110. The vortex draws fluid in through the bottom inlet 109 and forces it radially outward. The majority of the fluid, and the debris contained therein, never directly interact with the vortex vanes 114 which makes it more resistant to clogging. The top impeller 112 and bottom impeller 114 of the double impeller 110 are separated by the impeller plate 116.

In standard operation, the motor 102 rotates the double suction impeller 110 which causes fluid to be drawn in through the top inlet 108 and the bottom inlet 109 and expelled through the discharge 122. Both the top impeller 112 and the bottom impeller 114 create thrust along their axis when rotating. The axial thrust of the top impeller 112 is in the opposite direction as the axial thrust of the bottom impeller 114 and therefore is at least partially offsetting.

If the pump 100 is operated in a fluid with debris, the screen 106 may become clogged. If the screen 106 becomes clogged, the bottom impeller 114 of the double impeller 110 continues to pump fluid in through the bottom inlet 109 and out through the discharge 122. This allows the pump 100 to continue functioning in conditions where a pump with a single impeller (e.g., a single centrifugal impeller) would clog completely.

The top impeller 112 of the double impeller 110 is self-venting. This reduces the risk of the pump 100 failing due to air lock, making the pump more reliable than traditional bottom feed vortex pumps. Additionally, the top impeller 112 provides venting for the bottom impeller 114. In some embodiments, the top impeller 112 provides no suction and is used purely as a vent for the bottom impeller 114 to prevent air lock.

In other embodiments, the double impeller 110 has a top impeller 112 and a bottom impeller 114 that are of a different type than those discussed above. Example types of impellers include closed channel impellers, screw impellers, propellers, shredder impellers, mixed flow impellers, semi-open impellers, and hardened sand/slurry impellers in addition to the centrifugal impeller and vortex impeller described above. Each type of impeller has advantages and weaknesses. By having the top impeller 112 be a first type of impeller and the bottom impeller 114 be a second type of impeller, the pump 100 has the advantages of both impellers and does not fail in instances where a single one of the impellers would. Additionally the volute 120 would vary based on the combination of impellers used to have a bottom cavity 129 configured to house the type of impeller used for the bottom impeller 114 and a top cavity 128 configured to house the type of impeller used for the top impeller 112.

In other embodiments, the double impeller 110 has a top impeller 112 and a bottom impeller 114 that are of the same type as each other (e.g., dual vortex impellers, dual centrifugal impellers, etc.). However, in preferred forms utilizing at least one vortex impeller, the vortex impeller will always be situated on the bottom side or below the second impeller type to take advantage of the pump design illustrated and ensure some fluid moves through the pump even when the upper inlet gets clogged. As mentioned above, the top impeller 112 may further provide venting benefits for the bottom impeller 114 to prevent air lock and/or eliminate the need for a pump installer to drill a vent hole somewhere in the discharge pipe or plumbing of the system. Additionally, the redundancy of having the two volutes (e.g., regardless of whether that means they are two portions of a common volute or literally two separate volutes) prevents system failure when a single inlet becomes clogged.

Figure 4:
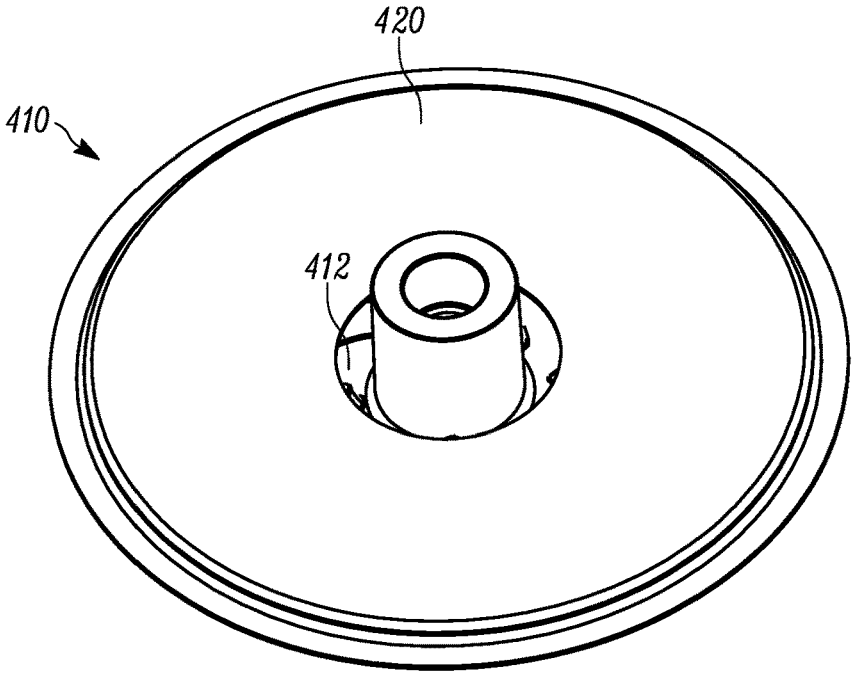
FIG. 4 illustrates a double suction impeller according to an embodiment of the present disclosure.

FIG. 4 illustrates a double impeller 410 according to an embodiment of the present invention. The double impeller 410 includes a seal plate 420. In the embodiment shown, the seal plate 420 is separate from the double impeller 410. In alternative embodiments, the seal plate 420 can be coupled to the impeller 410. In operation, the seal plate 420 creates a seal on the top inlet 108 that prevents fluid from back feeding and leaking across the vane. The seal plate 420 also increases the efficiency of the centrifugal vanes 412 by forcing all of the fluid flowing in the top inlet 108 to flow through the centrifugal vanes 412.

Figure 5:
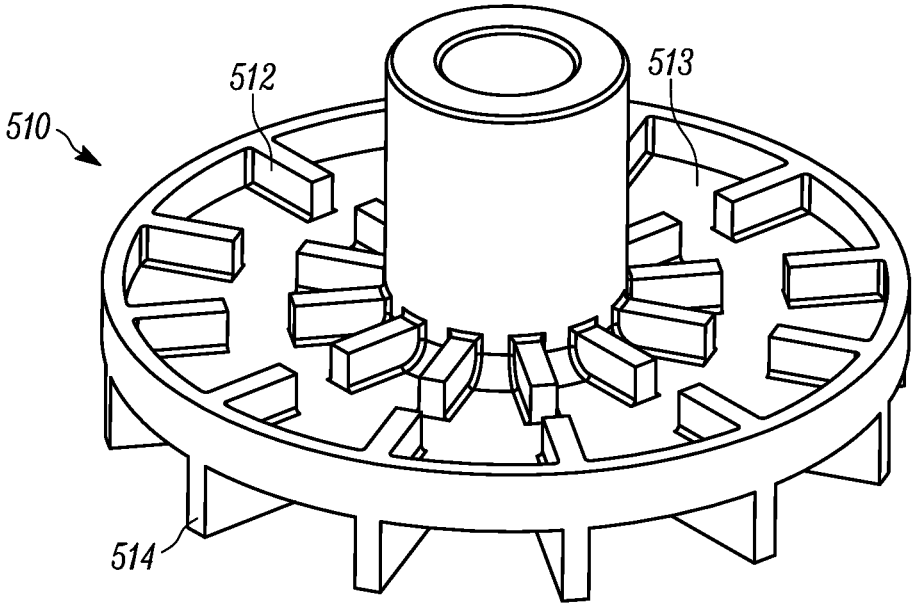
FIG. 5 illustrates an impeller according to an embodiment of the present disclosure.

FIG. 5 illustrates an impeller 510 according to an embodiment of the present disclosure. Pumps using the impeller 510 primarily draw fluid inward through a single inlet, the bottom inlet 109, and the top inlet 108 in the volute 120 is used as a vent to reduce air lock. The impeller 510 includes bottom vanes 514 and top vanes 512. The bottom vanes 514 induce flow to draw fluid in through the bottom inlet 109 and out the outlet 122. The top vanes 512 serve to reduce the static pressure and reduce the leaking of fluid out of the top inlet 108. The top vanes 512 and the bottom vanes 514 each can be shaped like those on any known type of impeller including, but not limited to, closed channel impellers, screw impellers, propellers, shredder impellers, mixed flow impellers, semi-open impellers, and hardened sand/slurry impellers in addition to the centrifugal impeller and vortex impeller described above. In some embodiments, the top vanes 512 include a notch 513 that creates a dynamic seal. The notch 513 draws in fluid, such as air, from the top inlet 108 and induces a flow in it so as to create an air barrier preventing fluid from leaking out of the top opening 108.

Figure 6A:
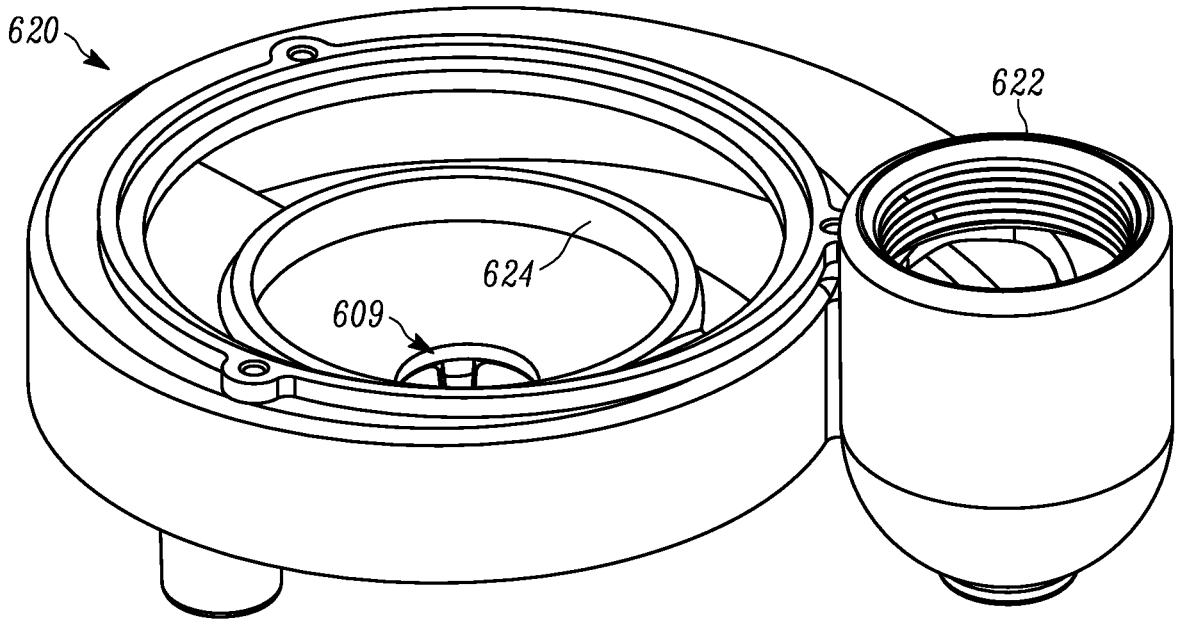
FIG. 6A is a perspective view of an alternative volute.
Figure 6B:
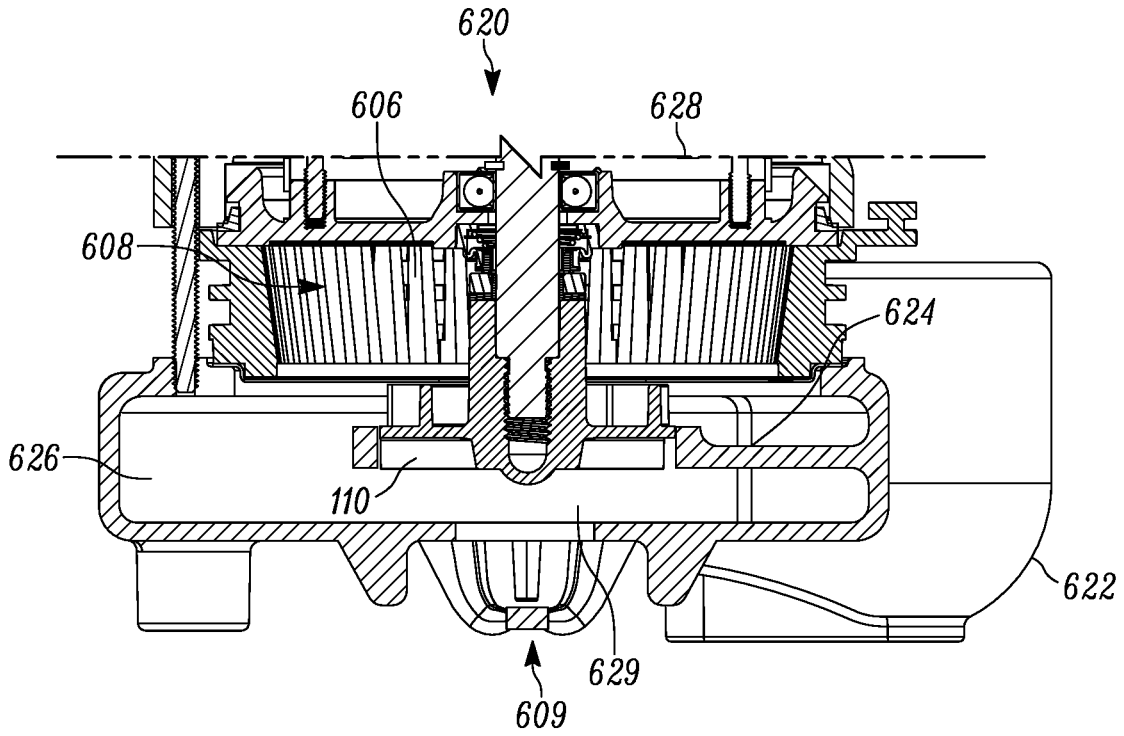
FIG. 6B is a cross-sectional view of the pump of FIGS. 1A-1C taken along line 1C of FIG. 1B having the volute of FIG. 6A.

In some embodiments, a divided volute 620 houses the double impeller 110. Referring to FIGS. 6A-6B, the volute 620 has a ring 624 in which the bottom impeller 114 of the double impeller 110 is set. The ring 624 and the impeller plate 116 collectively form a recess, surrounding the vortex vanes 214 on all but one side (the bottom). Having the sides of the vortex vanes 214 surrounded or encircled by the ring 624 may create a better vortex, which results in less debris being drawn into the double impeller 110. The top impeller 112 of the double impeller 110 is above the ring 624 with the centrifugal vanes 212 in the flow path of the fluid. As explained above, this permits the centrifugal vanes 212 to draw in fluid and then force it out to the side. The outer cavity 626 of the volute 620 connects the top cavity 628 and the bottom cavity 629. The flow of fluid produced by both the top impeller 112 and the bottom impeller 114 of the double impeller 110 join in this outer cavity 126 and flows out of the same discharge 122. In some forms, the volute 620 is used in combination with the impeller 510 such that the top inlet 608 is used substantially for venting while the bottom inlet 609 is used to intake fluid. Alternatively or additionally, the seal plate 420 is used in a pump having the volute 620 to reduce discharge through the top inlet 608.

This detailed description described specific examples of pumps. A person of ordinary skill in the art would recognize that these descriptions are sufficient to understand how to build and/or operate any of the pumps disclosed herein. Therefor this description covers the methods of making or using the pumps and/or individual components of the pumps described (e.g., methods of manufacturing a dual flow impeller, methods of manufacturing a dual inlet pump, etc.). For example, in addition to the numerous impeller, volute and pump embodiments disclosed herein, there are also disclosed methods of manufacturing a dual inlet pump with dual flow characteristics. In a preferred form, the pump will be provided with a dual flow impeller configured to offer two distinct flow types or characteristics. For example, the dual flow impeller may have a centrifugal portion on one side and a vortex portion on a second side to generate centrifugal fluid flow at one inlet and vortex fluid flow (e.g. a vortices) at a second inlet to offer redundancy and ensure that fluid continues to flow through the pump even if one input gets clogged or slowed significantly. The benefit of such redundancy is that it greatly reduces the likelihood that the surrounding area or environment the pump is used in will flood.

In other forms, the dual flow impeller may be configured to offer similar flow types or characteristics. For example, the dual flow impeller may be configured with two vortex portions, each positioned by a respective inlet unique to that portion of the volute to generate a vortex flow (e.g., vortices) proximate each inlet. Alternatively, in other forms, the dual flow impeller may be configured with two centrifugal portions, each positioned by a respective inlet unique to that portion of the volute to generate centrifugal flow proximate each inlet. Either of these configurations offer redundancy as well, they just do not offer dual flow characteristics like the preferred embodiment mentioned above. One reason the preferred embodiment is preferred is that by offering a pump with dual flow characteristics that are distinct from one another allows the pump to be a multi-functioning pump that can use the different flow characteristics to address fluids with different characteristics or are not consistent in their makeup. For example, the centrifugal inlet of the pump may move fluid with less contaminants or debris better, while the vortex input may move the fluid with more contaminants or debris better. In other applications, this level of redundancy may not be needed and it may be sufficient to simply include two inputs with similar flow characteristics (e.g., an impeller with two vortex portions, an impeller with two centrifugal portions, an impeller with two grinder portions, etc.).

While it mentions that the inlets may be unique to each impeller portion, it should be understood that in alternate embodiments the inlets may have some overlap with one another and so that they are only primarily associated with one impeller portion or the other. In still other forms, the inlet may be configured as one large inlet opening that feeds both impeller portions.

Other methods disclosed herein include methods of manufacturing a dual flow impeller, methods of processing fluid through a pump/pump inlet/impeller, methods for providing redundancy in a pump, methods for generating different fluid flow in, through, or via a pump, and/or methods for pumping fluids having different characteristics or make-up (e.g., methods for pumping fluids having a lower debris content portion and a higher debris content portion).

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

What is claimed is:

1. A pump comprising:

a motor configured to rotate a shaft;

an impeller operatively coupled to the shaft; and a fluid chamber housing the impeller, the fluid chamber having a top, a bottom and a side positioned between the top and bottom, the fluid chamber having a first inlet extending through the top of the fluid chamber, a second inlet extending through the bottom of the fluid chamber, and a discharge in fluid communication with the first and second inlets and extending through the side of the fluid chamber radially outward of the impeller, wherein the fluid chamber is configured to be submerged in a fluid such that rotation of the impeller draws fluid into the fluid chamber via the first inlet and the second inlet and forces the fluid out the discharge, wherein the bottom of the fluid chamber is configured to engage a surface and space the second inlet away from the surface to allow fluid to flow therethrough.

2. The pump of claim 1 wherein the second inlet is in fluid communication with the first inlet.

3. The pump of claim 2 wherein the second inlet is configured to vent air from the first inlet.

4. The pump of claim 1 wherein the impeller is a double impeller, the double impeller having a first impeller configured to create a first type of flow and a second impeller configured to create a second type of flow, the second type of flow being different from the first type of flow, wherein the first inlet configured to permit flow to the first impeller and the second inlet configured to permit flow to the second impeller.

5. The pump of claim 4, wherein the first impeller is a vortex impeller.

6. The pump of claim 5 wherein the fluid chamber has a ring positioned to encircle the vortex impeller.

7. The pump of claim 5 wherein the fluid chamber defines an inner recess that corresponds in shape to an outer diameter of the vortex impeller to form a defined vortex impeller fluid chamber portion.

8. The pump of claim 5, wherein the second impeller is a centrifugal impeller.

9. The pump of claim 8 wherein the double impeller includes a plate having a first side and a second side opposite the first side, the first impeller formed on the first side of the plate and the second impeller formed on the second side of the plate, the centrifugal impeller positioned or oriented above the vortex impeller.

10. The pump of claim 4 wherein the first and second impellers are both centrifugal impellers formed on opposite sides of a common body.

11. The pump of claim 4 wherein the first and second impellers are both vortex impellers formed on opposite sides of a common body.

12. The pump of claim 4 wherein the second impeller is configured to induce flow to create a dynamic seal.

13. The pump of claim 12 wherein the second impeller comprises a plurality of notched vanes.

14. The pump of claim 1 further comprising a seal plate, the seal plate configured to prevent back feeding through the second inlet.

15. The pump of claim 1 wherein the first and second inlets are connected to a single chamber defined by the fluid chamber housing within which the impeller is disposed.

16. A volute comprising:

a first cavity containing a first impeller portion;

a second cavity containing a second impeller portion;

a third cavity connecting the first cavity and the second cavity to a discharge;

a first inlet extending through a top surface of the volute and in fluid communication with the first impeller portion; and a second inlet extending through a bottom surface of the volute and in fluid communication with the second impeller portion, wherein the volute is configured to be submerged in a fluid such that the fluid enters the first cavity via the first inlet and enters the second cavity via the second inlet; and wherein the bottom surface of the volute is configured to engage a surface and space the second inlet away from the surface to allow the fluid to flow therethrough.

17. The volute of claim 16, wherein the first impeller portion is configured to house a centrifugal impeller and the second impeller portion is configured to house a vortex impeller.

18. The volute of claim 17, the volute further comprising a ring encircling the second impeller portion.

19. The volute of claim 16 wherein the first, second and third cavities are connected together to form a common inner chamber within which the impeller is disposed and the first and second inlets are connected to the common inner chamber such that fluid flowing through either the first inlet or the second inlet travels through the common inner chamber.

20. A method of pumping fluid with a pump, the method comprising:

operating a motor to rotate a double impeller within a fluid chamber, the double impeller having a first impeller and a second impeller, the fluid chamber being submerged in a fluid and having a top, a bottom and a side positioned between the top and bottom;

creating a first flow with the first impeller, the first flow extending through a first inlet extending through the top of the fluid chamber;

creating a second flow with the second impeller, the second flow extending through a second inlet extending through the bottom of the fluid chamber;

directing the first flow and the second flow out a single discharge extending through a side of the fluid chamber radially outward of the double impeller, wherein the bottom of the fluid chamber is configured to engage a surface and space the second inlet away from the surface to allow fluid to flow therethrough.

21. The method of claim 20 wherein creating the first flow includes inducing centrifugal flow.

22. The method of claim 21 wherein creating the second flow includes inducing vortex flow.

23. The method of claim 20 wherein the first and second impellers are formed on opposite sides of a common body and creating the first flow includes inducing centrifugal flow over a first side of the common body and inducing vortex flow includes inducing vortex flow over a second side of the common body.

24. The method of claim 20 wherein the first inlet, second inlet and single discharge are connected to a housing defining a common interior chamber within which the double impeller is disposed and directing the first flow and the second flow out a single discharge comprises directing the first flow and the second flow through the common interior chamber housing the double impeller and out the single discharge.

25. A method of manufacturing a pump comprising:

providing a pump having a fluid chamber configured to be submerged in a fluid and having a top, a bottom and a side positioned between the top and bottom, a first inlet extending through the top of the fluid chamber, a second inlet extending through the bottom of the fluid chamber, and a discharge extending through the side of the fluid chamber, the bottom of the fluid chamber configured to engage a surface and space the second inlet away from the surface to allow fluid to flow therethrough; and providing a dual flow impeller having a first impeller portion positioned proximate the first pump inlet to pump fluid through the first inlet, and having a second impeller portion positioned proximate the second pump inlet to pump fluid through the second inlet.

26. The method of claim 25 wherein the dual flow impeller is an integral or one-piece structure having the first impeller portion on a first side of the integral or one-piece structure and the second impeller portion on a second side of the integral or one-piece structure, and the method further comprises positioning the integral or one-piece structure in the interstitial space between the first inlet and the second inlet so that fluid from the first inlet flows over the first side of the integral or one-piece structure and fluid from the second inlet flows over the second side of the integral or one-piece structure.

* * * * *